US008696521B2

(12) United States Patent
Wu

(10) Patent No.: US 8,696,521 B2
(45) **Date of Patent: *Apr. 15, 2014**

(54) EXERCISER WITH LENGTH-ADJUSTABLE INELASTIC STRAP

(76) Inventor: Ying-Ching Wu, Tainan (TW)

( * ) Notice: Subject to any disclaimer, the term of this patent is extended or adjusted under 35 U.S.C. 154(b) by 465 days.

This patent is subject to a terminal disclaimer.

(21) Appl. No.: 13/093,024

(22) Filed: Apr. 25, 2011

(65) Prior Publication Data

US 2012/0270706 A1 Oct. 25, 2012

(51) Int. Cl.
*A63B 21/00* (2006.01)

(52) U.S. Cl.
USPC ..... 482/35; 482/904; 482/907

(58) Field of Classification Search
USPC ..... 482/904, 35, 907, 91, 95, 126, 129, 43, 482/69
See application file for complete search history.

(56) References Cited

U.S. PATENT DOCUMENTS

| | | | | |
|---|---|---|---|---|
| 6,322,483 | B1 * | 11/2001 | Rotella | 482/129 |
| 6,921,354 | B1 * | 7/2005 | Shifferaw | 482/91 |
| 7,090,622 | B2 * | 8/2006 | Hetrick | 482/92 |
| 7,255,666 | B2 * | 8/2007 | Cardenas | 482/143 |
| 7,326,157 | B2 | 2/2008 | Wu | 482/126 |
| 2003/0158024 | A1 * | 8/2003 | Saure | 482/126 |

* cited by examiner

*Primary Examiner* — Jerome w Donnelly
(74) *Attorney, Agent, or Firm* — Alan Kamrath; Kamrath IP Lawfirm, P.A.

(57) ABSTRACT

An exerciser includes a suspension member having an extension strap. A connecting ring is fixed to a first end of the extension strap. A second end of the extension strap is wound around a positioning rod slideable on a linking ring to allow adjustment of an overall length of the extension strap. A hook is fixed to a looped attachment member and releasably engaged with one of the connecting ring and a first ring on the extension strap. A handle is slideably mounted around the attachment member. A connecting strap has an end fixed to the linking ring. A stop is fixed to the other end of the connecting strap. A second ring can be fixed to the connecting strap, and an attachment belt can be attached to the second ring. Two handles of two suspension members can be attached to two ends of a bar.

3 Claims, 12 Drawing Sheets

EXERCISER WITH LENGTH-ADJUSTABLE INELASTIC STRAP

BACKGROUND OF THE INVENTION

The present invention relates to an exerciser and, more particularly, to an exerciser including a length-adjustable inelastic suspension member and a handle allowing the exerciser to exercise the muscles by performing exercises resisting the weight of the user.

A wide variety of exercisers is available on the market for exercising the muscles by resisting weights. An example of the exercisers of this type is dumbbells. Various exercisers are required for exercising muscles of different parts of the human body. These exercisers are generally expensive and occupy a large space. Some of the exercisers allowing the user to resist the weight of a portion of the components of the exercisers have certain weights and volumes and are, thus, not suitable for use in homes. General users can only use small-size exercisers such as dumbbells.

Thus, a need exists for an exerciser that can be used at home.

BRIEF SUMMARY OF THE INVENTION

The present invention solves this need and other problems in the field of exercisers providing convenient use by providing, an exerciser including a first suspension member having an extension strap with first and second ends and a side extending between the first and second ends of the extension strap. A connecting ring is fixed to the first end of the extension strap. A positioning rod is mounted to a linking ring and slideable between upper and lower ends of the linking ring and between a disengagement position and a clamping position. The second end of the extension strap is wound around the positioning rod. A first ring is fixed to the side of the extension strap and located between the first and second ends of the extension strap. An attachment member in the form of a looped belt includes a hook fixed thereto. The hook is releasably engaged with one of the connecting ring and the first ring. A handle is slideably mounted around the attachment member and includes a longitudinal through-hole extending along a longitudinal axis of the handle. The attachment member slideably extends through the longitudinal through-hole of the handle. The handle is slideable relative to the attachment member between first and second positions. The handle is located around an intermediate section of the attachment member when the handle is in the first position. The handle is spaced from the intermediate section of the attachment member when the handle is in the second position. A connecting strap includes first and second ends. The second end of the connecting strap is fixed to the upper end of the linking ring. A stop is fixed to the first end of the connecting strap and has cross sections larger than the connecting strap.

When the positioning rod is in the disengagement position, the positioning rod is spaced from the lower end of the linking ring by a spacing allowing the second end of the extension strap to move towards or away from the first end of the extension strap, adjusting an overall length of the extensions strap.

When the positioning rod is in the clamping position adjacent to the lower end of the linking ring, the extension strap is frictionally retained between the positioning rod and the linking ring.

In a form shown, a second ring is fixed to a surface between the first and second ends of the connecting strap. The first extension strap further includes an attachment belt. Two hooks are respectively attached to two ends of the attachment belt and releasably engaged with the second ring of the connecting strap, with the attachment belt forming a loop.

In another form shown, the exerciser further includes a bar and a second suspension member identical to the first suspension member. The handles of the first and second suspension members are releasably attached to two ends of the bar and have a fixed spacing therebetween.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
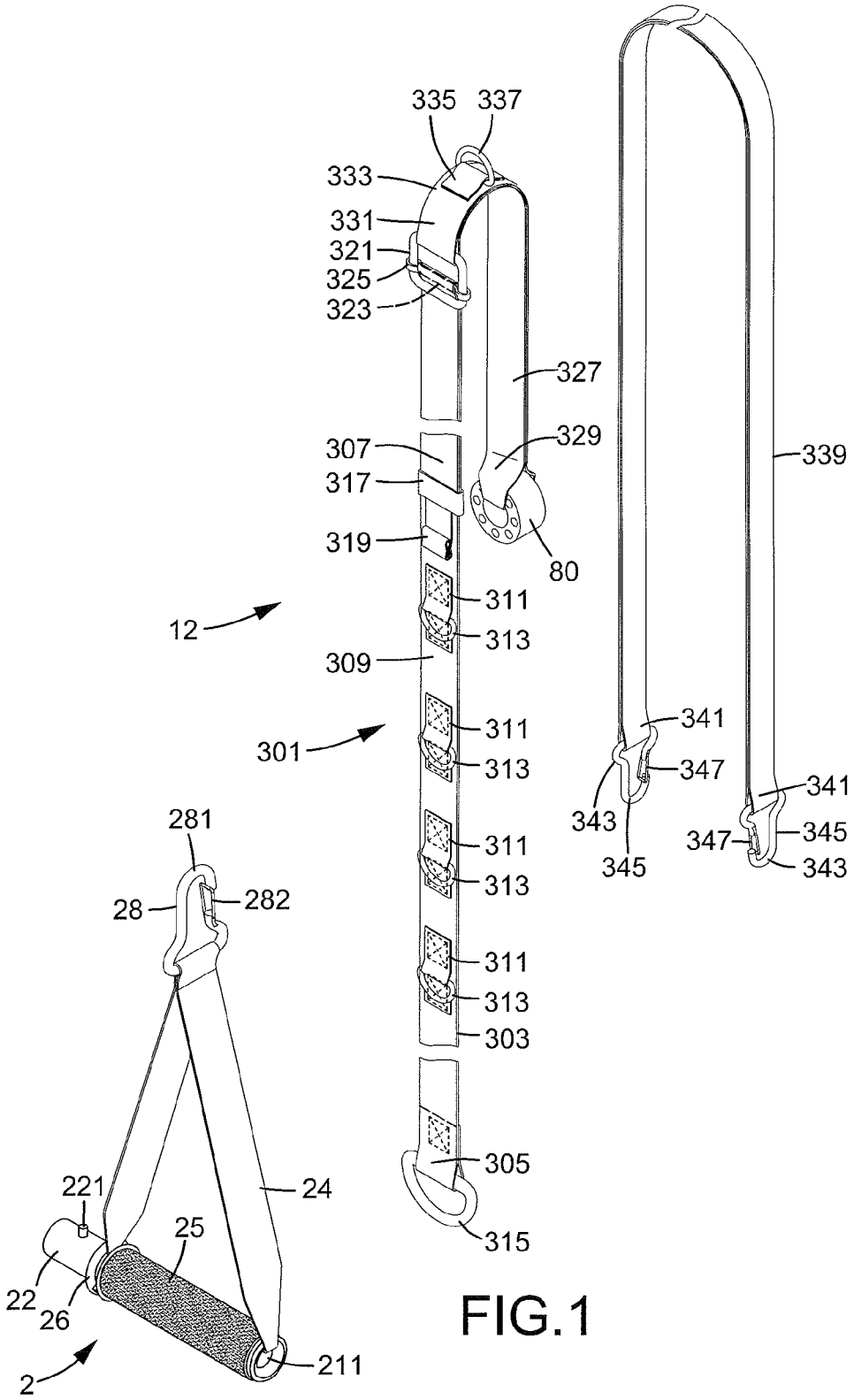
FIG. 1 shows an exploded, perspective view of an example of an exerciser according to the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "upper", "lower", "outer", "side", "end", "portion", "section", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
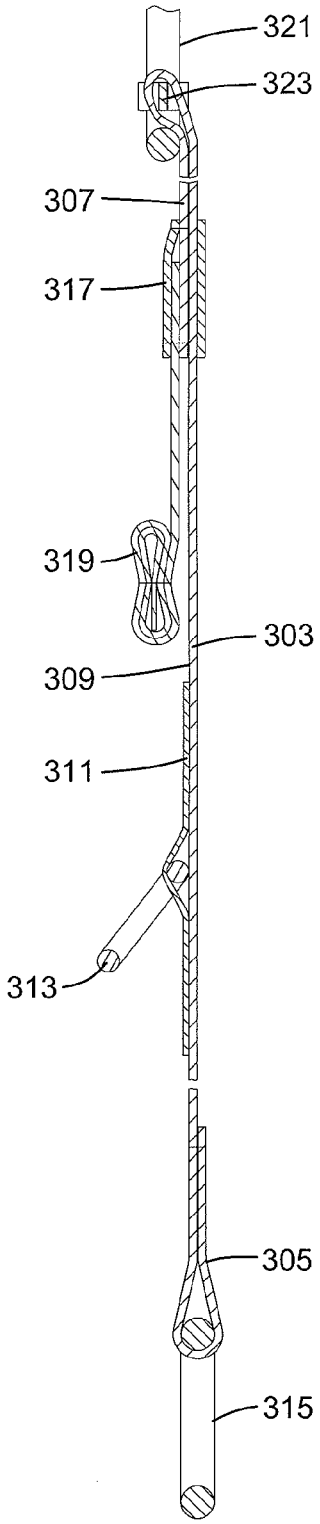
FIG. 2 shows a cross sectional view of an extension strap of the exerciser of FIG. 1.

An exerciser according to the present invention is shown in the drawings and generally designated 12. According to the form shown, exerciser 12 includes a first suspension member 301 including an extension strap 303 made of inelastic fabric of canvas or nylon. Extension strap 303 includes first and second ends 305 and 307 spaced in a longitudinal direction and two sides 309 extending between first and second ends 305 and 307. First end 305 of extension strap 303 is wound around a rectilinear section of a semi-circular connecting ring 315 and then sewn to one of sides 309, attaching connecting ring 315 to first end 305. Second end 307 of extension strap 303 is wound around a positioning rod 323 and extends towards but spaced from first end 305. A square linking ring 321 includes upper and lower ends and two parallel arms extending between the upper and lower ends. Positioning rod 323 includes two ring portions 325 mounted around the parallel arms of linking ring 321, allowing positioning rod 323 to slide along the arms of linking ring 321 between a disengagement position and a clamping position. Second end 307 of extension strap 303 is wound around positioning rod 323 between ring portions 325. A sliding loop 317 made of inelastic fabric of canvas or nylon is sewn to second end 307 of extension strap 303. Sliding loop 317 is located between first and second ends 305 and 307 of extension strap 303 (FIG. 2). A pull strip 319 has an end sewn between sliding loop 317 and second end 307 of extension strap 303 (FIG. 2).

Figure 3:
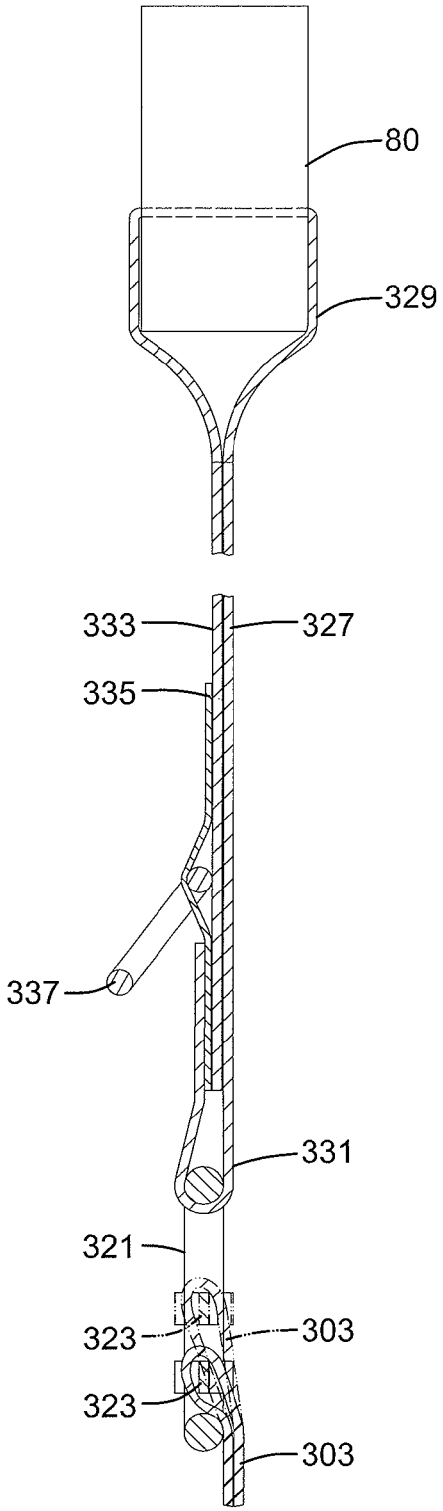
FIG. 3 shows a cross sectional view of a connecting strap of the exerciser of FIG. 1.

When positioning rod 323 is in the clamping position adjacent to the lower end of linking ring 321 (see the solid lines in FIG. 3), extension strap 303 is frictionally retained between positioning rod 323 and linking ring 321. Thus, second end 307 of extension strap 303 can not be moved by pulling pull strip 319. On the other hand, when positioning rod 323 is in the disengagement position spaced from the lower end of linking ring 321 (see the phantom lines in FIG. 3) by a sufficient spacing, such that pull strip 319 can be pulled to move second end 307 of extension strap 303 towards or away from first end 305. In a case that second end 307 of extension strap 303 is moved towards first end 305, the overlapped portion of extension strap 303 is increased, shortening a spacing between connecting ring 315 and linking ring 321. In another case that second end 307 of extension strap 303 is moved away from first end 305, the overlapped portion of extension strap 303 is decreased, increasing the spacing between connecting ring 315 and linking ring 321.

According to the form shown, first suspension member 301 further includes four first fixing straps 311 made of inelastic fabric of canvas or nylon. First fixing straps 311 are sewn to one of sides 309 of extension strap 303, are spaced from each other in the longitudinal direction, and are located between first and second ends 305 and 307. Each first fixing strap 311 has a first spacing to connecting ring 315 and a second spacing to linking ring 321. The first spacing is larger than the second spacing. Thus, movement of sliding loop 317 will not be hindered by first fixing strap 311. Specifically, when second end 307 of extension strap 303 is located in a position most adjacent to first end 305, the four first fixing straps 311 are located between first and second ends 305 and 307. However, second end 307 can be moved to a location adjacent to first end 305 if extension strap 303 does not include first fixing straps 311. A semi-circular first ring 313 is attached between each first fixing strap 311 and extension strap 303.

According to the form shown, first suspension member 301 further includes a connecting strap 327 made of inelastic fabric of canvas or nylon. Connecting strap 327 includes first and second ends 329 and 331 and a surface 333 extending between first and second ends 329 and 331. A cylindrical stop 80 is attached to first end 329 of connecting strap 327. Second end 331 of connecting strap 327 is engaged with the upper end of linking ring 321. Stop 80 has a volume significantly larger than that of connecting strap 327. A second fixing strap 335 made of inelastic fabric of canvas or nylon is sewn to surface 333 of connecting strap 327 at a location adjacent to linking ring 321. A semi-circular second ring 337 is attached to second fixing strap 335.

According to the form shown, first suspension member 301 further includes a handle 2. Handle 2 is tubular and includes a longitudinal through-hole 211 extending along a longitudinal axis of handle 2. Handle 2 further comprises a grip portion 21 and a connecting portion 22 extending from grip portion 21 along the longitudinal axis and having at least one protrusion 221. In the form shown, connecting portion 22 includes two diametrically opposed protrusions 221 formed by two exposed portions of a pin 23 that transversely extends through connecting portion 22. Handle 2 further includes two spaced flanges 26 between grip portion 21 and connecting portion 22. A slot 27 is defined in an annular wall 29 between flanges 26 and in communication with through-hole 211. A protective padding member 25 is mounted around grip portion 21 for comfort gripping.

Figure 4:
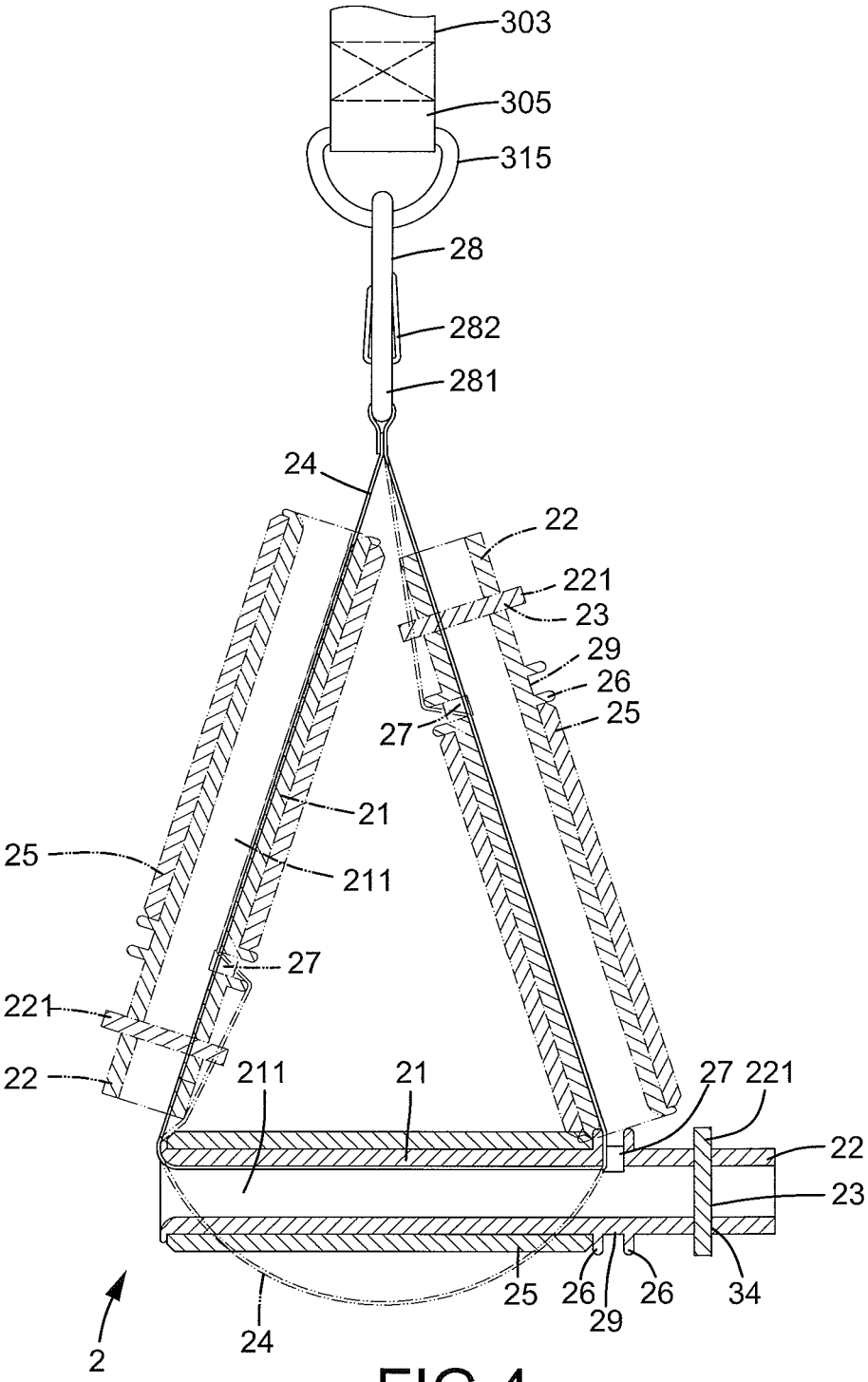
FIG. 4 shows a cross sectional view of a portion of the extension strap and a handle of the exerciser of FIG. 1.
Figure 5:
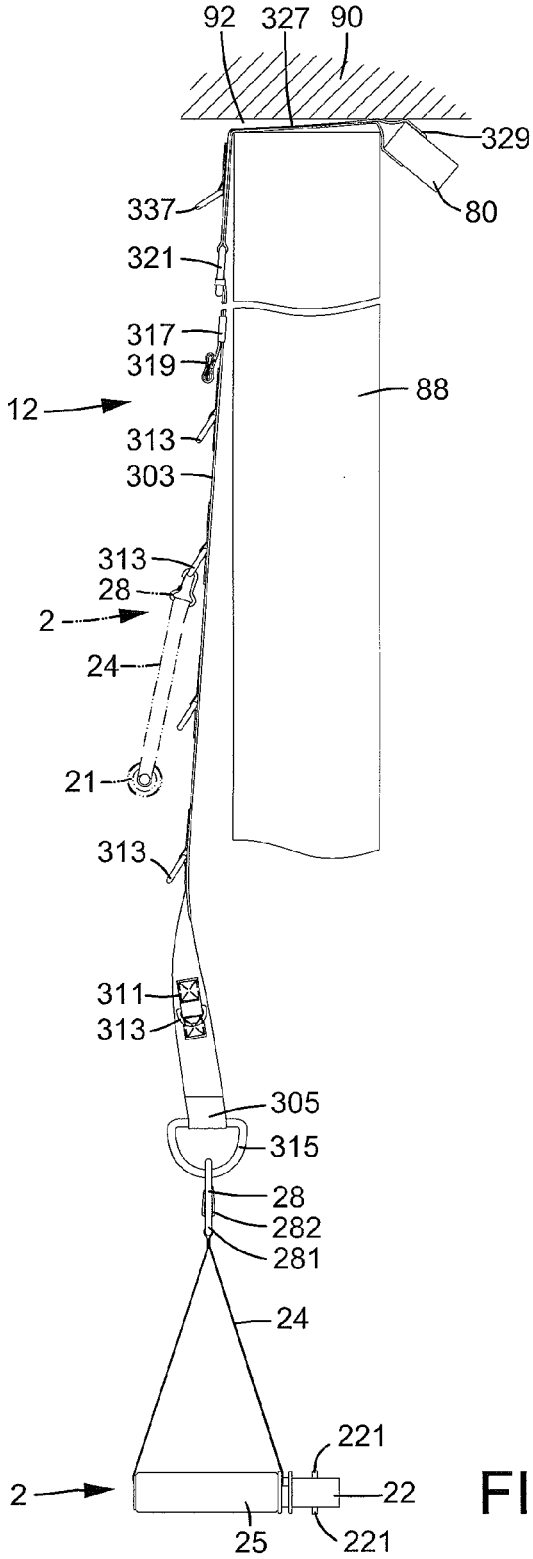
FIG. 5 shows a schematic view illustrating use of the exerciser of FIG. 1 on a door.
Figure 6:
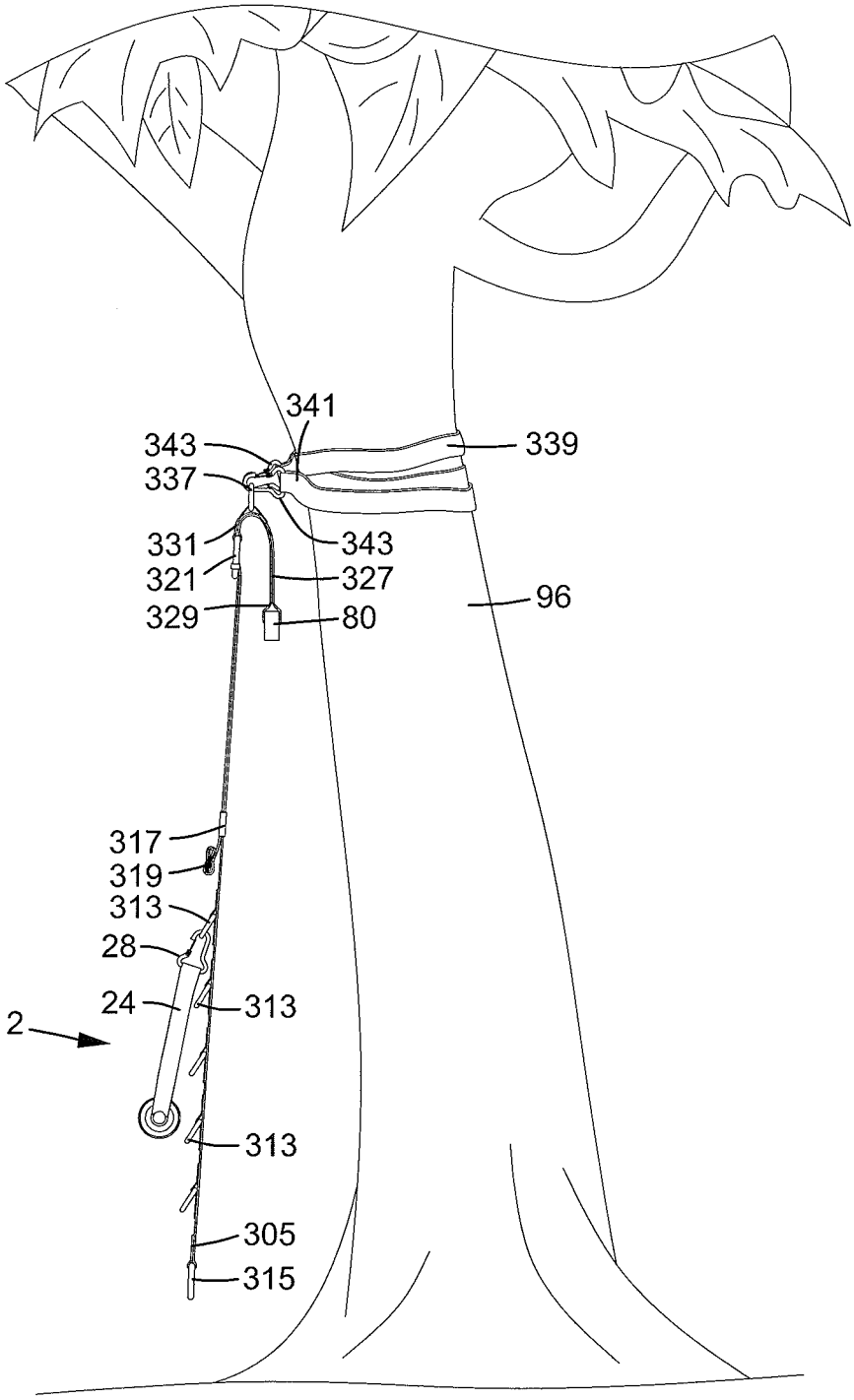
FIG. 6 shows a schematic view of the exerciser of FIG. 1 assembled for use around a trunk.

According to the form shown, first suspension member 301 further includes an attachment member 24 in the form of a belt made of inelastic fabric of canvas or nylon and slideably mounted to handle 2. Attachment member 24 is a loop having a portion extending through longitudinal through-hole 211 and slot 27 of handle 2 (FIG. 4). A hook 28 is attached to attachment member 24 and spaced from handle 2 and includes a hook portion 281 and a resilient plate 282 for closing an opening of hook portion 281. A spacing between hook portion 281 and through-hole 211 or a spacing between hook portion 281 and slot 27 is larger than a sum of a length of grip portion 21 and a length of connecting portion 22 of handle 2 along the longitudinal axis. Namely, attachment member 24 has a length significantly larger than an overall length of handle 2, such that handle 2 can slide along attachment member 24 between first and second positions. When handle 2 is located in the first position (see the solid lines in FIG. 4), handle 2 receives an intermediate section of attachment member 24, and a spacing between an end of grip portion 21 of handle 2 and hook 28 is approximately equal to a spacing between an end of connecting portion 22 and hook 28. When handle 2 is located in the second position (see handle 2 shown in phantom lines and located at the left or right section of attachment member 24), handle 2 is spaced from and does not receive the intermediate section of attachment member 24, providing a space for receiving a foot of a user.

Handle 2 can be detachably attached to one of connecting ring 315 and four first rings 313 by hook 28. Connecting ring 315 and first rings 313 to be coupled with handle 2 can be selected according to the required overall length of first suspension member 301. The user can proceed with minor adjustment of the overall length of extension strap 303 by moving second end 307 of extension strap 303 by manually pulling pull strip 319. When handle 2 is attached to connecting ring 315 and when pull strip 319 is adjacent to linking ring 321, first suspension member 301 has the maximum length. When handle 2 is attached to the first ring 313 closest to sliding loop 317 and when sliding loop 317 is adjacent to the first fixing strap 311 closest to linking ring 321, first suspension member 301 has the minimum length.

In an example of use, handle 2 is attached by hook 28 to connecting ring 315. Exerciser 12 can be mounted between two objects. Specifically, connecting strap 327 is extended through a gap 92 between a first object 88 (such as a door) and a second object 90 (such as a door frame). Stop 80 is firmly stuck between first and second objects 88 and 90. Disengagement will not occur when connecting strap 327 is subjected to a force pulling connecting strap 327 away from stop 80, because stop 80 has a volume much larger than gap 92. It can be appreciated that handle 2 can be attached to any one of first rings 313. The user can proceed with weight training to resist the weight while the body is slanted relative to the ground.

In the form shown, first suspension member 301 further includes an attachment belt 339 made of inelastic fabric of canvas or nylon. Attachment belt 339 includes two ends 341 each having a hook 343. Each hook 343 includes a hook portion 345 and a resilient plate 347 for closing an opening of hook portion 345. In the form shown, attachment belt 339 has a length approximately four times that of connecting strap 327.

Exerciser 12 can be engaged with a thin third object 94 without using attachment belt 339. However, through use of attachment belt 339, exerciser 12 can be engaged with a fourth object 96 (such as a trunk) that is too thick to be wound around by connecting strap 327. Attachment 339 is tied around fourth object 96. Then, hooks 343 on attachment belt 339 are engaged with second ring 337. Thus, first suspension member 301 is securely attached to fourth object 96.

Figure 8:
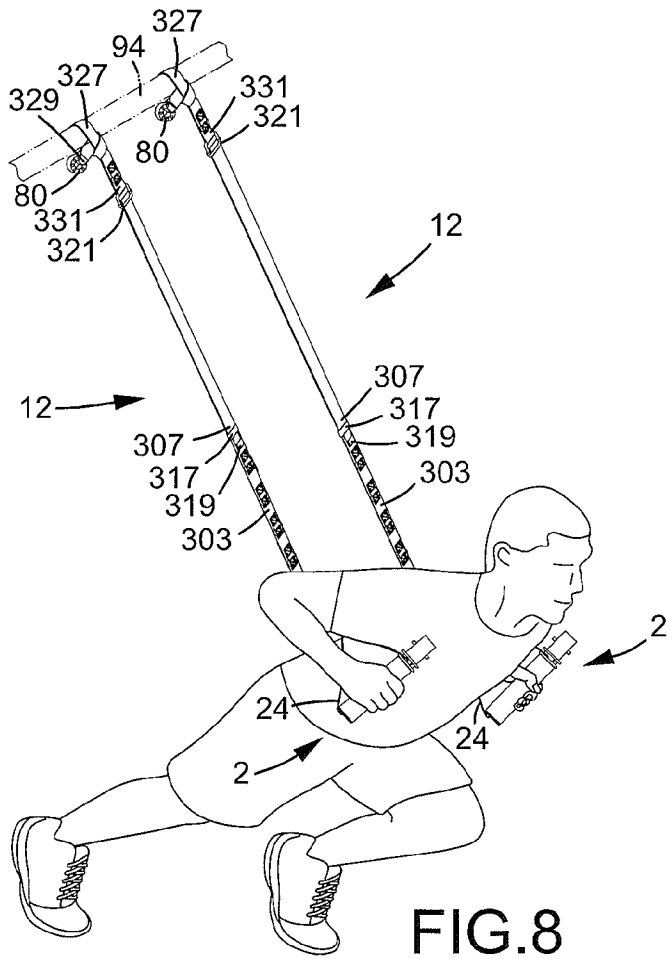
FIGS. 7-10 illustrate poses of a user using a second example of the exerciser according to the present invention.
Figure 7:
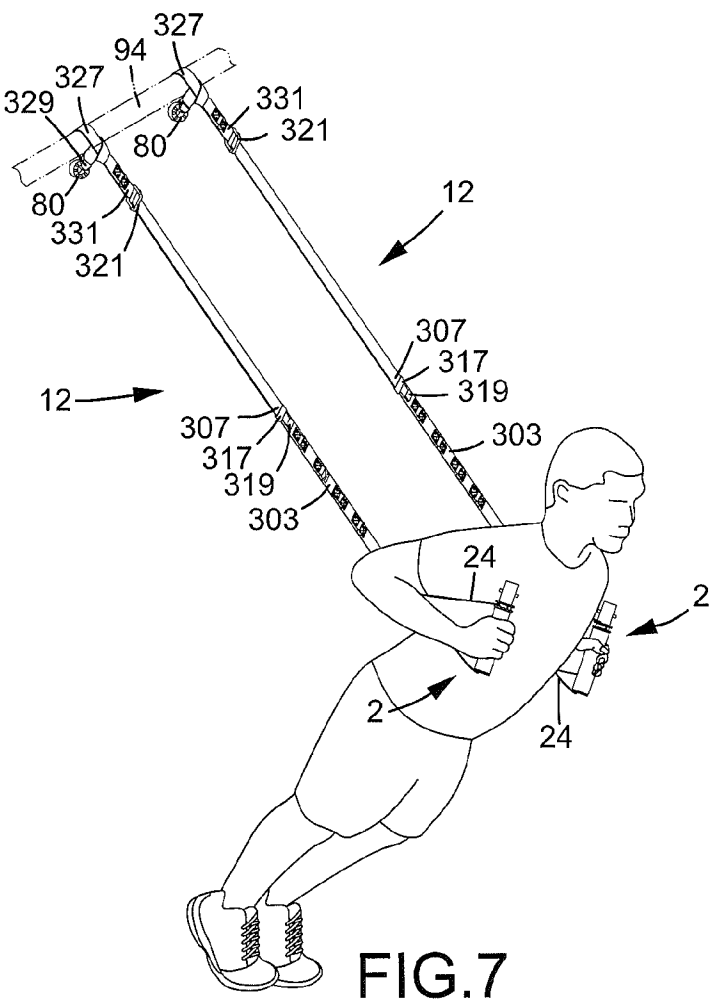
Figure 10:
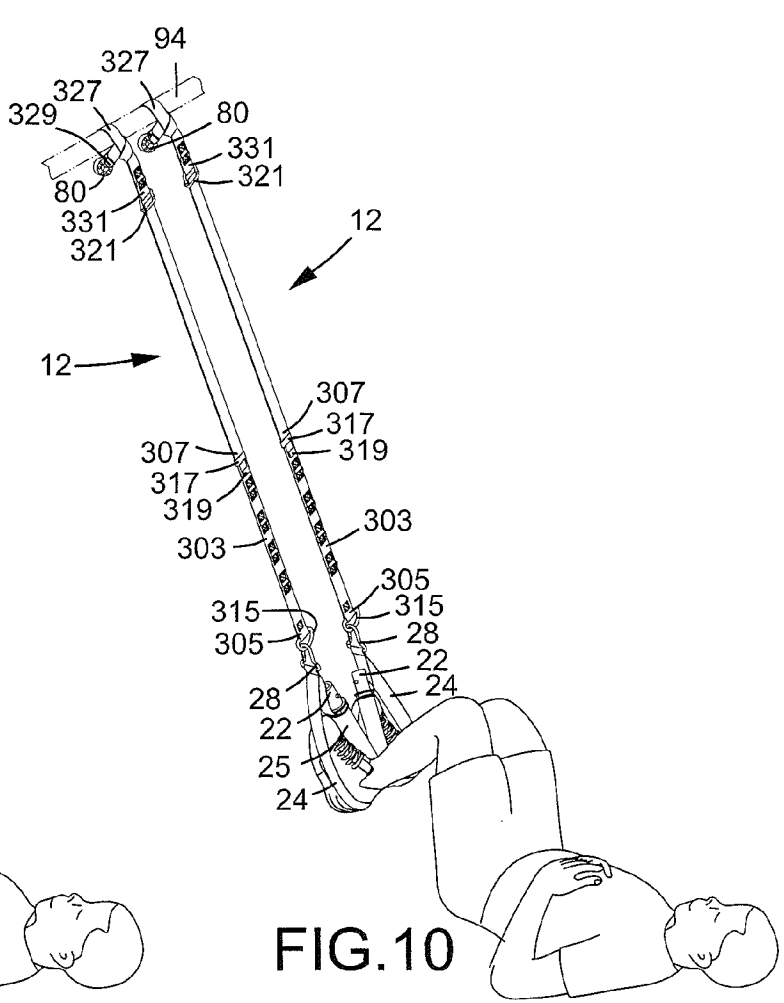
Figure 9:
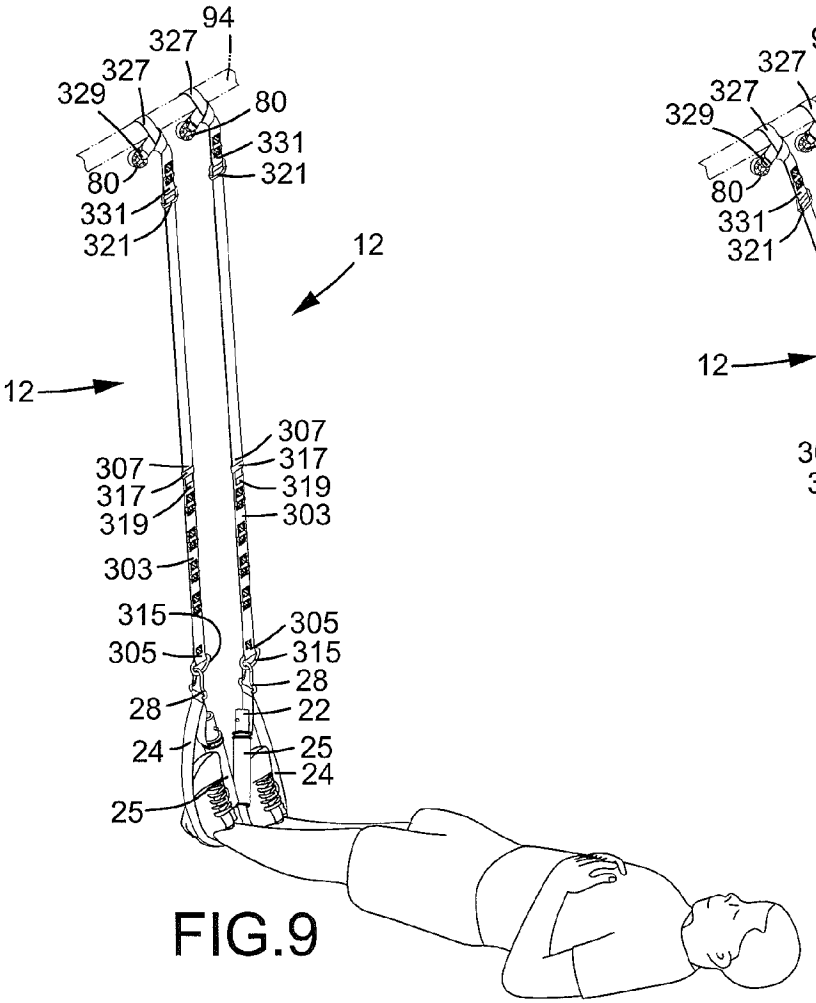

FIGS. 7-10 show examples of use of a second example of exerciser 12. Specifically, exerciser 12 includes first and second suspension members 301. Second suspension member 301 is identical to first suspension member 301 in the form shown. In use, connecting strap 327 of each of first and second suspension members 301 is tied around rod-like third object 94 by a knot. Since stop 80 of each of first and second suspension members 301 is much larger than the gaps of the knots, the knots will not become loose when first and second suspension members 301 are pulled, avoiding disengagement of first and second suspension members 301 from third object 94. The user can grip handles 2 with both hands and proceed with various exercises, examples of which are shown in FIGS. 7 and 8. Furthermore, the user can lie down on the user's back and hook handles 2 by the heels of the shoes worn by the user. The user can proceed with various exercises, examples of which are shown in FIGS. 9 and 10.

Since handles 2 can be selectively engaged with connecting ring 315 or any first ring 313, the overall length of exerciser 12 can be rapidly adjusted according to the needs of users of various sizes.

Figure 11:
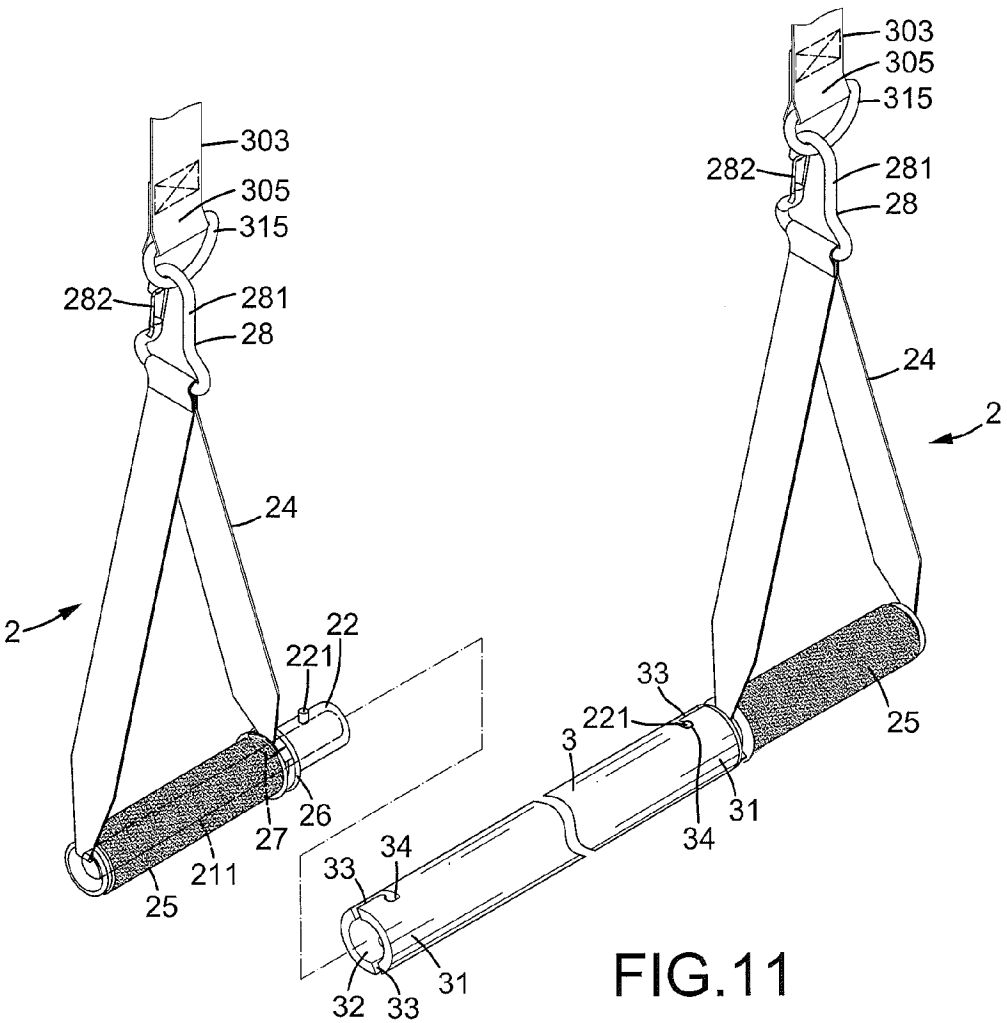
FIG. 11 shows a partial, exploded, perspective view of a third example of the exerciser according to the present invention.

FIG. 11 shows a third example of exerciser 12. In this example, first and second suspension members 301 are coupled together by a bar 3. Specifically, bar 3 has a length suitable for gripping by a user after handles 2 are attached to two ends 31 of bar 3. At least one end 31 of bar 3 includes an engaging hole 32 for coupling with a handle 2. In the form shown in FIG. 11, each end 31 of bar 3 includes an engaging hole 32 for coupling with an associated handle 2. Each engaging hole 32 may be an annular recess in an end face of the associated end 31 of bar 3. In the form shown, bar 3 includes a longitudinal through-hole, with two ends of the longitudinal through-hole of bar 3 respectively forming engaging holes 32.

In the form shown in FIG. 11, each end 31 of bar 3 includes at least one longitudinal guiding slot 33 extending longitudinally inward from an end face of end 31 and at least one transverse positioning slot 34 extending from an inner end of longitudinal guiding slot 33. Each of longitudinal guiding slot 33 and transverse positioning slot 34 has a width allowing passage of protrusion 221 of the associated handle 2. In this embodiment, each end 31 of bar 3 includes two diametrically opposed longitudinal guiding slots 33 and two diametrically opposed transverse positioning slots 34 respectively extending from inner ends of the longitudinal guiding slots 33.

Figure 12:
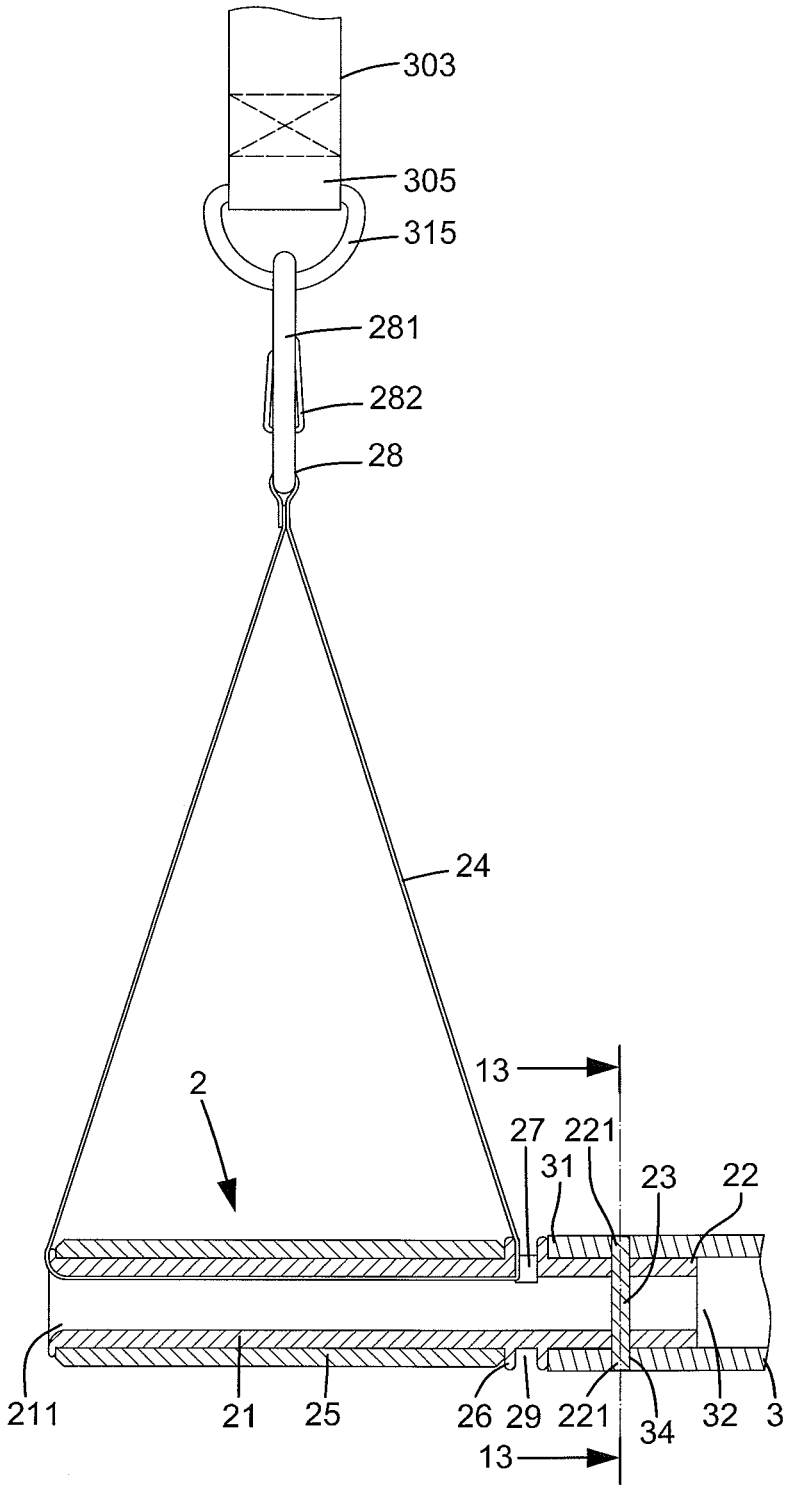
FIG. 12 shows a partial, cross sectional view of the third example of the exerciser according to the present invention.
Figure 13:
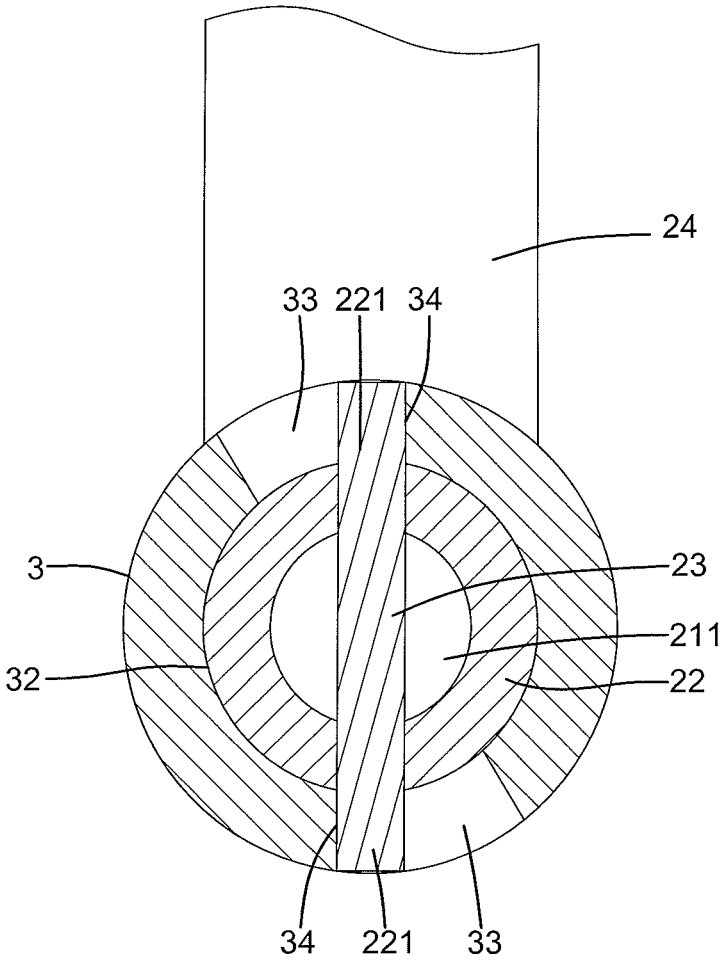
FIG. 13 shows a cross sectional view taken along section line 13-13 of FIG. 12.

The length of each longitudinal guiding slot 33 is equal to the distance between an associated protrusion 221 and an adjacent flange 26 of an associated handle 2. Thus, when connecting portion 22 of each handle 2 is inserted into an associated end 31 of bar 3, protrusions 221 reach the inner ends of longitudinal guiding slots 33 of the associated end 31 when the flange 26 adjacent to the protrusions 221 comes in contact with the end face of the associated end 31 of bar 3, as shown in FIG. 12. Each handle 2 is then turned in a circumferential direction, with each protrusion 221 moving along the associated transverse positioning slot 34 of the associated end 31 of bar 3 to a position shown in FIGS. 11 and 13. Disengagement of handles 2 from bar 3 is, thus, prevented. Disassembling of handles 2 can be easily accomplished by reverse operation of handles 2. Namely, assembling and disassembling of handles 2 are easy to the user.

Figure 15:
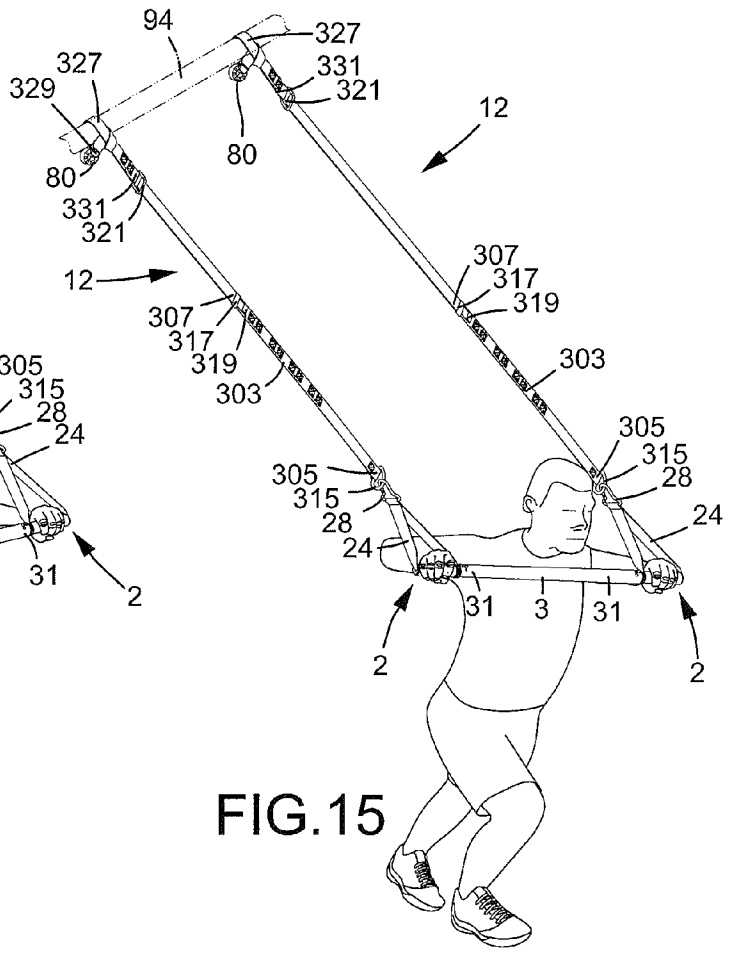
FIGS. 14 and 15 show poses of a user using the third example of the exerciser according to the present invention.
Figure 14:
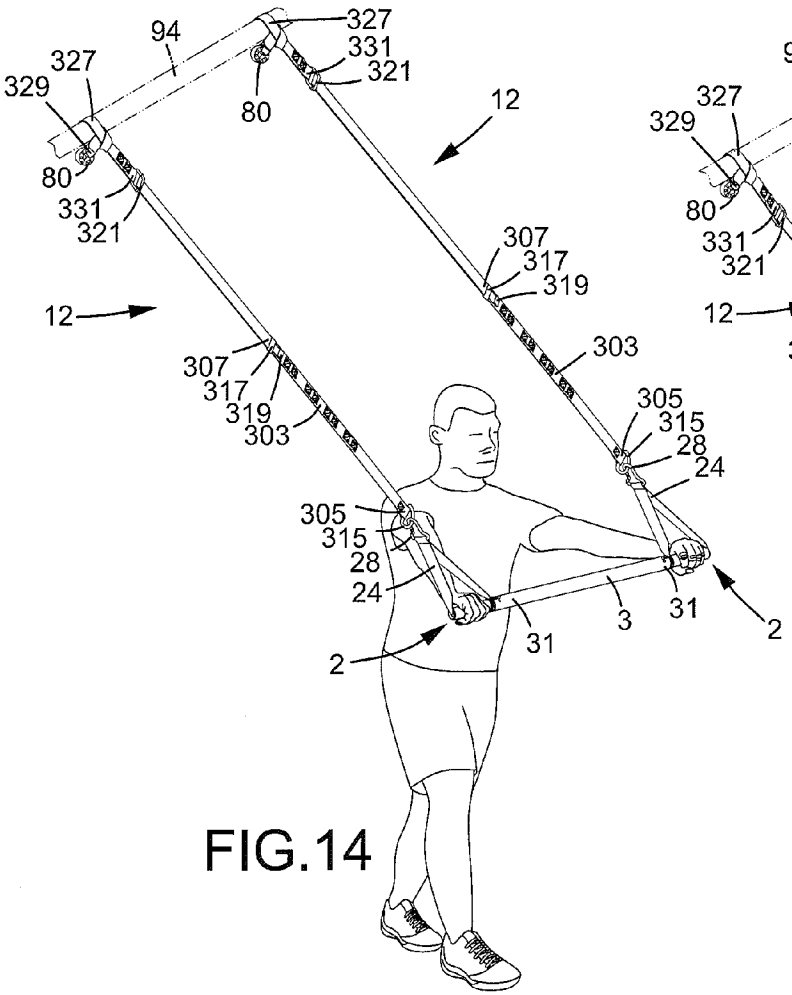

In use of the third example, connecting strap 327 of each of first and second suspension members 301 is tied around rod-like third object 94. First and second suspension members 301 are spaced from each other. Bar 3 is interconnected between handles 2. The user grips handles 2 to proceed with various exercises, examples of which are shown in FIGS. 14 and 15. The spacing between handles 2 is limited by bar 3, avoiding injury to the user resulting from imbalance due to uneven force applied to handles 2.

Exerciser 12 can be used in differing conditions and allows the user to proceed with various exercises against the weight of the user to exercise different muscles of the user. Exerciser 12 is light and occupies a small space, allowing easy storage.

Now that the basic teachings of the present invention have been explained, many extensions and variations will be obvious to one having ordinary skill in the art. For example, exerciser 12 does not have to include attachment belt 339 and second ring 337. Furthermore, exerciser 12 does not have to include sliding loop 317 and pull strip 319. In this case, second end 307 of extension strap 303 can not be fixed. However, the length of extension strap 303 can still be adjusted by pulling second end 307.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An exerciser comprising a first suspension member, with the first suspension member including:

an extension strap including first and second ends and a side extending between the first and second ends of the extension strap;

a connecting ring fixed to the first end of the extension strap;

a linking ring having upper and lower ends;

a positioning rod mounted to the linking ring, with the positioning rod slideable between the upper and lower ends of the linking ring and between a disengagement position and a clamping position, with the second end of the extension strap wound around the positioning rod;

a first ring fixed to the side of the extension strap and located between the first and second ends of the extension strap;

an attachment member in the form of a looped belt and including a hook fixed thereto, with the hook releasably engaged with one of the connecting ring and the first ring;

a handle slideably mounted around the attachment member, with the handle including a longitudinal through-hole extending along a longitudinal axis of the handle, with the attachment member slideably extending through the longitudinal through-hole of the handle, with the handle slideable relative to the attachment member between first and second positions, with the handle located around an intermediate section of the attachment member when the handle is in the first position, with the handle spaced from the intermediate section of the attachment member when the handle is in the second position;

a connecting strap including first and second ends, with the second end of the connecting strap fixed to the upper end of the linking ring; and a stop fixed to the first end of the connecting strap and having cross sections larger than the connecting strap;

wherein when the positioning rod is in the disengagement position, the positioning rod is spaced from the lower end of the linking ring by a spacing allowing the second end of the extension strap to move towards or away from the first end of the extension strap, adjusting an overall length of the extensions strap, and wherein when the positioning rod is in the clamping position adjacent to the lower end of the linking ring, the extension strap is frictionally retained between the positioning rod and the linking ring.

2. The exerciser as claimed in claim 1, with the connecting strap further including a surface extending between the first and second ends of the connecting strap, with a second ring fixed to the surface of the connecting strap, with the first extension strap further including:

an attachment belt including two ends; and two hooks respectively attached to the two ends of the attachment belt, with the hooks releasably engaged with the second ring of the connecting strap, with the attachment belt forming a loop.

3. The exerciser as claimed in claim 1, with the handle of the first extension suspension member including a connecting portion extending from the grip portion along the longitudinal axis of the handle, with the exerciser further comprising, in combination: a second suspension member and a bar, with the bar including first and second ends, with the second suspension member including:

a second extension strap including first and second ends and a side extending between the first and second ends of the second extension strap;

a second connecting ring fixed to the first end of the second extension strap;

a second linking ring having upper and lower ends;

a second positioning rod mounted to the second linking ring, with the second positioning rod slideable between the upper and lower ends of the second linking ring and between a disengagement position and a clamping position, with the second end of the second extension strap wound around the second positioning rod;

a second ring fixed to the side of the extension strap and located between the first and second ends of the second extension strap;

a second attachment member in the form of a looped belt and including a second hook fixed thereto, with the second hook releasably engaged with one of the second connecting ring and the second ring;

a second handle slideably mounted around the second attachment member, with the second handle including a longitudinal through-hole extending along a longitudinal axis of the second handle, with the second attachment member slideably extending through the longitudinal through-hole of the second handle, with the second handle slideable relative to the second attachment member between third and fourth positions, with the second handle located around an intermediate section of the second attachment member when the second handle is in the third position, with the second handle spaced from the intermediate section of the second attachment member when the second handle is in the fourth position;

a second connecting strap including first and second ends, with the second end of the second connecting strap fixed to the upper end of the second linking ring; and a second stop fixed to the first end of the second connecting strap and having cross sections larger than the second connecting strap;

wherein when the second positioning rod is in the disengagement position, the second positioning rod is spaced from the lower end of the second linking ring by a spacing allowing the second end of the second extension strap to move towards or away from the first end of the second extension strap, adjusting an overall length of the second extensions strap, wherein when the second positioning rod is in the clamping position adjacent to the lower end of the second linking ring, the second extension strap is clamped between the second positioning rod and the second linking ring, and wherein the handle and the second handle of the first and second suspension members are releasably attached to the first and second ends of the bar, with the handle and the second handle having a fixed spacing therebetween.

* * * * *